US006020901A

United States Patent [19]

Lavelle et al.

[11] Patent Number: 6,020,901

[45] Date of Patent: Feb. 1, 2000

[54] FAST FRAME BUFFER SYSTEM ARCHITECTURE FOR VIDEO DISPLAY SYSTEM

[75] Inventors: Michael Lavelle, Saratogo; Alex Koltzoff, Corte Madera; David Kehlet, Los Altos, all of Calif.

[73] Assignee: Sun Microsystems, Inc., Palo Alto, Calif.

[21] Appl. No.: 08/884,953

[22] Filed: Jun. 30, 1997

[51] Int. Cl.[7] ..... G09G 5/36

[52] U.S. Cl. ..... 345/509; 345/203

[58] Field of Search ..... 345/507–509, 345/213, 501, 506, 502

[56] References Cited

U.S. PATENT DOCUMENTS

| | | | |
|---|---|---|---|
| 5,442,379 | 8/1995 | Bruce et al. | 345/199 |
| 5,544,306 | 8/1996 | Deering et al. | 345/507 |
| 5,617,367 | 4/1997 | Holland et al. | 365/219 |
| 5,696,534 | 12/1997 | Lavelle et al. | 345/507 |
| 5,745,125 | 4/1998 | Deering et al. | 345/508 |

OTHER PUBLICATIONS

Computer Graphics Proceedings, Annual Conference Series, "FBRAM: A New Form of Memory Optimized for 3D Graphics" pp. 167–174 by Deering et al, Jul. 1994.

IEEE Custom Intergrated Circuits Conference, "A 66 MHz DSP–Augmented RAMDAC for Smooth–Shaded Graphic Application" by Harston et al, pp. 15.5.1–15.5.4,May 1991.

*Primary Examiner*—Kee M. Tung

*Attorney, Agent, or Firm*—Flehr Hohbach Test Albritton & Herbert LLP

[57] ABSTRACT

A fast frame buffer system and architecture supports preferably 24-bit capability and includes an integer rendering pipeline, especially useful for three-dimensional applications. The system includes a frame buffer random access memory system ("FBRAM") that includes video source data and is configurable as a single-buffer or double-buffer, a fast frame buffer controller integrated circuit ("FFB ASIC") that includes system command and video refresh control functions, and a random access memory digital-to-analog converter unit ("RAMDAC") that includes the buffer system timing generator. A FBRAM controller unit provides both parallel accelerated rendering pipeline and direct access paths to the FBRAM unit. The timing generator outputs serial clock and serial clock enable signals, the latter signal preceding horizontal blanking signals by preferably N=1 serial clock pulses to compensate for pixel signal path timing delays.

23 Claims, 9 Drawing Sheets

FAST FRAME BUFFER SYSTEM ARCHITECTURE FOR VIDEO DISPLAY SYSTEM

FIELD OF THE INVENTION

The present invention relates generally to frame buffers used in computer video display systems, and more specifically to frame buffers and frame buffer architecture to improve realtime performance of video display systems.

BACKGROUND OF THE INVENTION

Modern three-dimensional computer graphics use geometry extensively to describe three-dimensional objects, using a variety of graphical representation techniques. Computer graphics find especially wide use in applications such as computer assisted design ("CAD") programs. Complex smooth surfaces of objects to be displayed may be represented using high level abstractions. Detailed surface geometry may be rendered using texture maps, although providing more realism requires raw geometry, usually in the form of triangle primitives.

FIG. 1 depicts a prior art generic video system 10 such as may used with a computer system, e.g., a Sun Microsystems, Inc. SPARC workstation, to display user-to display user-generated images. Using a drawing program, for example, such images may be created with a mouse, trackball or other user input devices 20 for display on a video monitor 30, among other uses. Within the context of the invention to be described, displayed objects 40, 50 typically will have a three-dimensional surface, and commonly a portion of one object may be hidden by a portion of another object. In FIG. 1, for example, a portion of object 40 appears in front of and thus covers a hidden surface portion of object 50.

Input data from device 20 typically is coupled to a device bus 60, from where coupling to a video processing system 70 occurs, as well as coupling to computer system input/output interface unit 80, and a computer system memory controller unit 90. Units 80 and 90 are typically coupled to a system bus 100 that also is coupled to the system central processor unit ("CPU") 110, and to the computer system persistent memory unit 120. Among other tasks, CPU 110 may be involved with processing triangular data representing the three dimensional surface of the object to be displayed on monitor 30.

CPU-processed video information is coupled via system bus 100, memory controller 90, device bus 60 into video system 70. Video system 70 typically includes a graphics accelerator unit 140, a video frame buffer random access memory unit (e.g., "3DRAM") 150 (or other form of RAM video store) and a video control unit 160. Processed video from video system 70 is then coupled to monitor 30, which displays images such as images 40 and 50.

A so-called Z-buffer unit 144 associated with graphics accelerator unit 130 stores a "Z-value", e.g., a depth-value, for each pixel that is to be rendered and displayed. Pixel values for object 50, for example, should only be overwritten when object 50 is closer to a viewing position than the Z-value that is already stored for that pixel value. The Z-buffer must ensure that objects that are far away from a view point are projected behind objects that are closer to the view point, e.g., portions of object 50 should appear behind object 40, which is nearer to the viewpoint. Further, objects should appear smaller as their distance from the viewpoint increases. The pixel drawing relationship typically is represented by a function that is inversely proportional to distance. This concept is commonly what is meant by Z-buffering, and the Z-data may be referred to as Z-buffered primitives.

Monitor 30 typically is an analog device that requires separate red, blue, green ("R,B,G") input video lines, Thus, frame buffer 150 includes a random access memory digital-to-analog converter ("RAMDAC") 162 that outputs R,B,G analog signals and digital synchronization ("SYNC") signals to the display monitor.

Video control unit 160 typically includes video timing generator 164 and outputs video signals and video timing signals that control movement of video data into and out of frame buffer RAM unit 150.

Unfortunately, the architecture shown in prior art FIG. 1 has been outpaced by the ever increasing demand for faster and more complex display imagery. Displaying three dimensional graphics animation with full color depth simply exceeds the bandwidth of such prior art systems. The result is an unrealistic and jerky sequence of display frames.

There is a need for an architecture for the frame buffer in a video display system that enhances realtime performance of the overall system. Preferably such architecture should be capable of implementation with off-the-shelf generic subsystem components.

The present invention discloses such an architecture.

SUMMARY OF THE PRESENT INVENTION

The present invention provides a fast frame buffer system and architecture that supports preferably 24-bit capability and provides an integer rendering pipeline, especially useful for three-dimensional and Windows™-like applications. The system includes a frame buffer random access memory system ("FBRAM"), a fast frame buffer controller that preferably is an application-specific integrated circuit ("FFB ASIC"), and a random access memory digital-to-analog converter unit ("RAMDAC"). The FBRAM unit is configurable as a single-buffer or a double-buffer unit and can frame buffer 1.25 million pixels over 32 or 96 planes, respectively. The FBRAM controller unit provides both parallel accelerated rendering pipeline and direct access paths to the FBRAM unit.

Frame buffering functions are partitioned such that FFB ASIC control unit includes a command unit and a video refresh control unit for the system, the FFBRAM unit includes the video data source, and the system timing generator is provided within the RAMDAC unit.

The video refresh unit receives input field and scan signals from the RAMDAC-located video timing generator. Further, the video refresh unit outputs transfer commands to FBRAM unit-located registers and logic, which also receive serial clock ("SC") and serial clock enable ("SCEN") signals from the RAMDAC-located video timing generator. The video timing generator provide video and timing signals, and ensures that the blanking and synchronization signals align with the pixel data, notwithstanding that the pixel data has a different skew. Alignment is promoted by causing the SCEN signal to precede the horizontal blank signal by N-shifted clock pulses to compensate for timing delays.

Other features and advantages of the invention will appear from the following description in which the preferred embodiments have been set forth in detail, in conjunction with the accompanying drawings.

DETAILED DESCRIPTION OF THE PREFERRED EMBODIMENT

Figure 1:
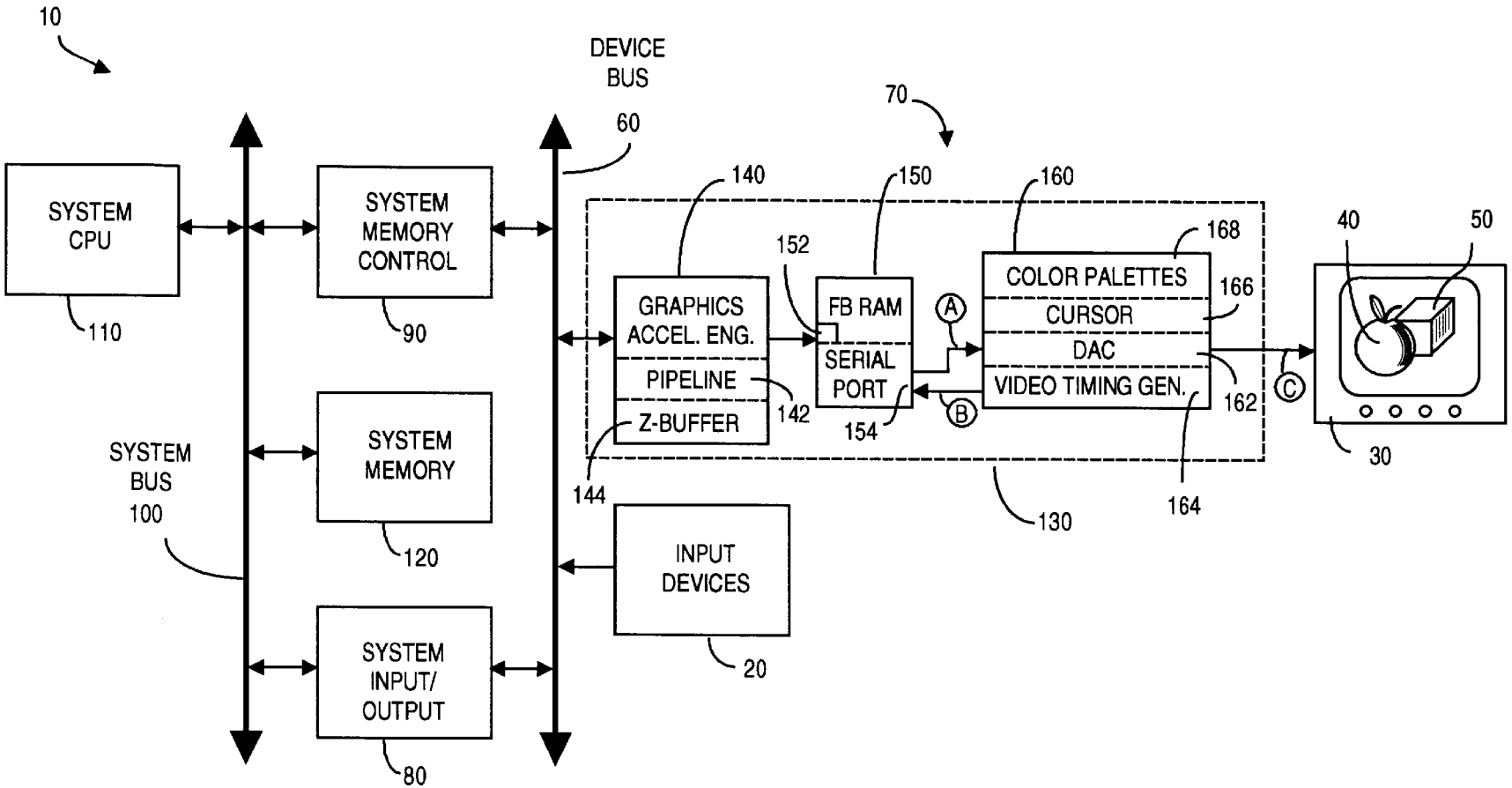
FIGURE 1 (PRIOR ART)
FIG. 1 depicts a video system including a frame buffer, according to the prior art.
Figure 2:
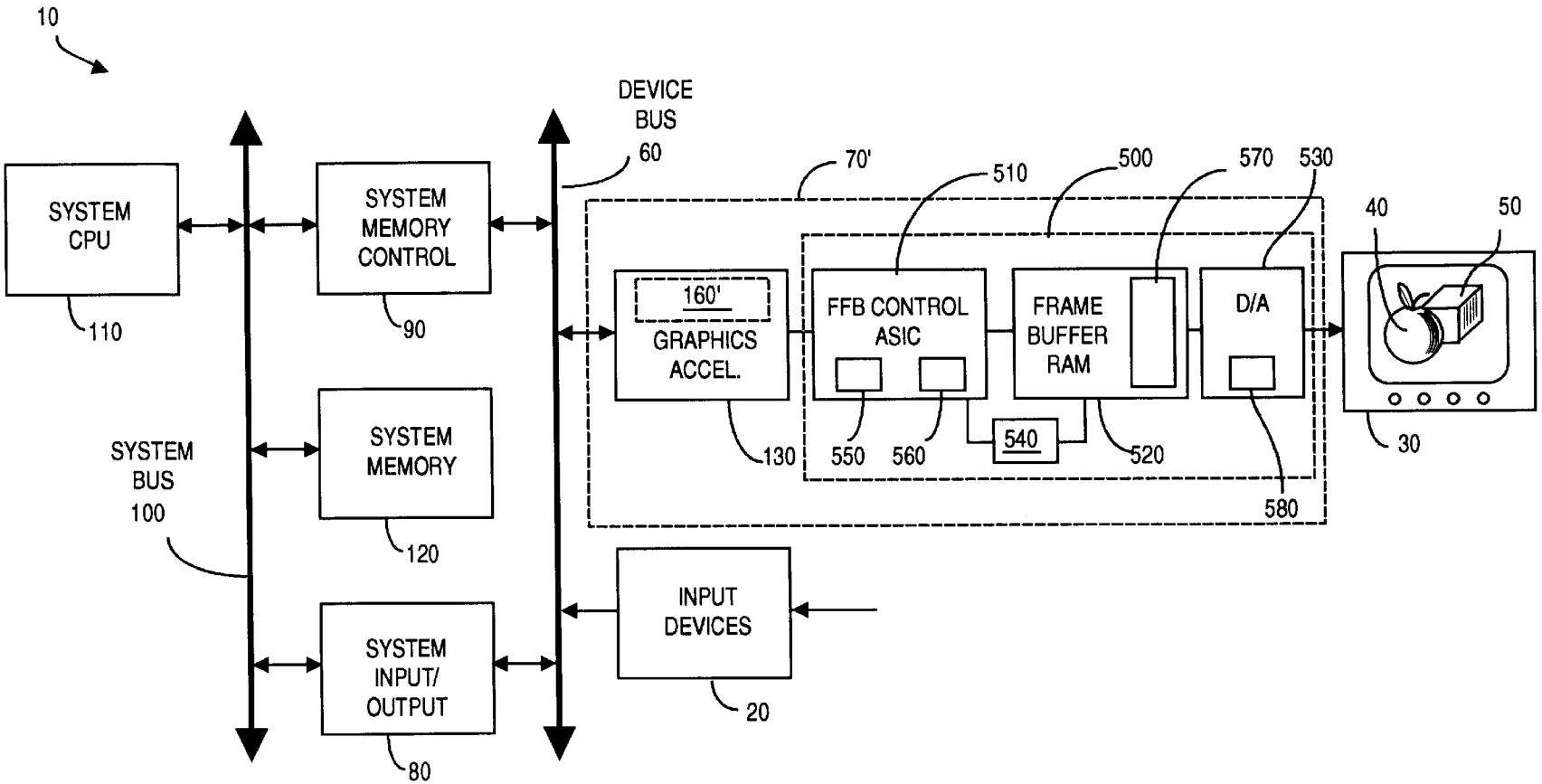
FIG. 2 depicts a video system including frame buffer architecture, according to the present invention.

FIG. 2 depicts a video system 10 provided with a video processing system 70', according to the present invention. Elements in FIG. 2 bearing like reference numbers as to elements shown in FIG. 1 may be the same elements. Where, for example, FIG. 1 includes a Z-buffer unit 144 and FIG. 2 includes a unit 160', unit 160' is understood to also be a Z-buffer unit, although the internal architecture may differ from what is found in a prior art Z-buffer unit.

The present invention is depicted in FIG. 2 as fast frame buffer system 500, which includes a preferably ASIC-implemented fast frame buffer control unit 510, a frame buffer random access memory system ("FBRAM") 520, a RAM digital-to-analog converter ("RAMDAC") unit 530 and preferably also a programmable read only memory unit ("PROM") 540. FFB control unit 510 preferably includes a refresh controller unit 550, and a command unit 560. FBRAM unit 520 preferably includes a video data source unit 570, and RAMDAC unit 530 preferably includes a timing generator unit 580. PROM unit 540 preferably is a 64 Kbyte memory used to initialize system 500 when the host workstation or computer system is powered on.

As evident from FIG. 2, the present invention partitions functioning of frame buffer components such that video timing generator 580 is included within RAMDAC 530, video refresh scheduling controller unit 550 and video command unit 560 is included in framebuffer controller 510, and video data source 570 is included in FFBRAM unit 520. As will be described, such architecture advantageously promotes system flexibility, data throughput, while maintaining necessary timing relationships between pixel data and display monitor synchronization signals.

Figure 3:
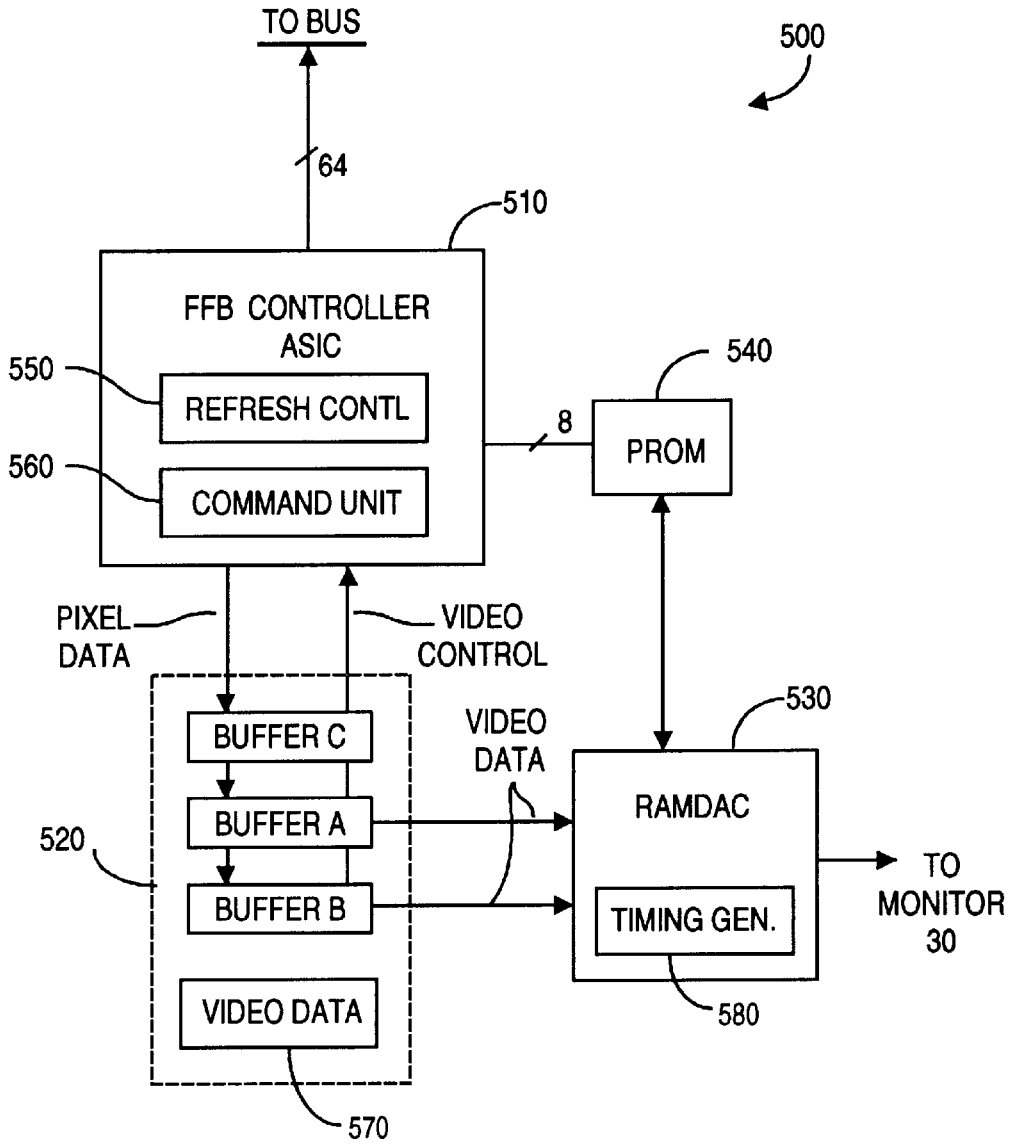
FIG. 3 is a block diagram of a single-buffered embodiment of the present invention.
Figure 4:
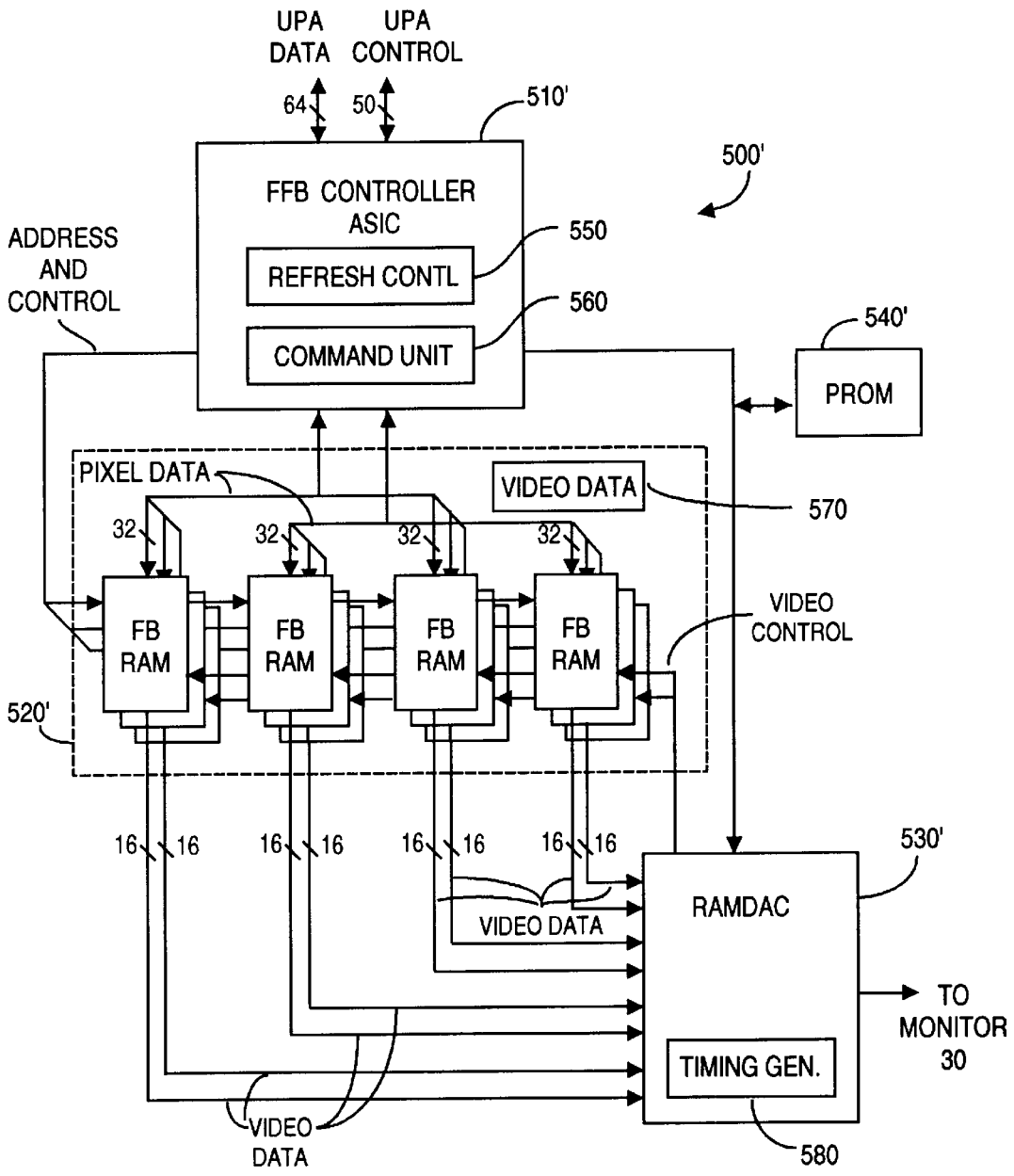
FIG. 4 is a block diagram of a double-buffered embodiment of the present invention.

FIGS. 3 and 4 are block diagrams of respective single-buffered fast frame buffer ("FFB") system 500 and double-buffered fast frame buffer system 500' embodiments of the present invention. Each embodiment includes a preferably ASIC FFB controller unit 510 or 510' that is preferably an application specific integrated circuit ("ASIC"), an FBRAM unit 520 or 520', RAMDAC unit 530 or 530', and a preferably programmable read only memory ("PROM") unit 540 or 540'. FBRAM units 520, 520' are digital RAM storage units of preferably 10 MByte or so capacity, into which display image digital data are stored. FBRAM unit 520 preferably comprises four FBRAM units, whereas FBRAM unit 520' preferably includes twelve FBRAM units. Units 520, 520' provide 24-bit frame buffering, wherein data are stored as a matrix of pixel intensity values, each display pixel being assigned from 1 to 24 bits.

Again, it is to be understood that ASIC FFB controller unit 510 will provide the same functions as unit 510' but may differ internally. The same statement is also true of RAMDAC units 530, 530' PROM unit 540, 540', refresh controller and command units 550, 550', 560, 560', video data source unit 570, 570, and timing generator 580, 580'.

The embodiments of FIGS. 3 and 4 differ primarily in the configuration of the FBRAM units. In the single-buffer configuration of FIG. 3, FBRAM unit 520 is configured into two buffers (A and B) of pixel data, and one buffer (C) of depth. This single-buffer configuration can frame buffer 1.25 million pixels over 32 planes, 8-bits each for X (used for Window ID and overlay codes), red, blue, and green ("R", "B", and "G").

In the double-buffer configuration of FIG. 4, 1.25 million pixels can be frame buffered over 96 planes. The double-buffered embodiment may be configured in several formats including 1600×1280 pixels (single-buffered), 1280×1024 (double-buffered), 1152×900 (double-buffered), 1024×768 (double-buffered), as well as PAL-format, NTSC-format, and quad-buffered stereo display formats. FBRAM units 520 and 520' preferably output digital red, green and blue pixel video data through individual output ports, to permit 24-bit true color rendition. The FBRAM units preferably are divided into four interleaves.

In either embodiment, RAMDAC 530, 530' converts digital data received from FBRAM unit 520, 520' output ports into analog format for monitor 30.

In the single-buffer configuration of FIG. 3, RAMDAC 530 preferably is a 64-bit 135 MHz unit, and in the double-buffer configuration of FIG. 4, RAMDAC 530' preferably is a 128-bit, 216 MHz unit. Either embodiment of the present invention can transfer 150 Mpixels/sec. from memory to FBRAM, and 75 MPixels/sec. from memory to FBRAM. In the preferred embodiment, RAMDACs 530, 530' were commercially available Pacifica, Inc. model Bt9068, Bt497, or Bt498 units.

In addition to timing generator 580, the RAMDAC units preferably also include an on-chip data multiplexer serializer to promote true color rendition, pseudo-color look-up tables, gamma correction tables, cursor control logic and color tables, and a serial monitor port. In the preferred embodiments, the RAMDAC units are accessed via a set of four interface registers, using indirect addressing.

The RAMDAC unit-located timing generator 580 provides video and FBRAM timing signals. Generator 580 preferably includes a phase-locked loop ("PLL") clock synthesizer, a pixel clock divider, and timing generation logic. Operating under program control, the PLL pixel clock synthesizer generates several different pixel clock frequencies to support various display resolutions. The pixel clock divider extends the range of the pixel clock synthesizer by digitally dividing synthesizer output frequencies by 1, 2 or 4. The pixel clock divider output is the serial clock signal (abbreviated "SC"), which is used for external FBRAM clocking and for internal clocking of the timing generator.

Figure 5:
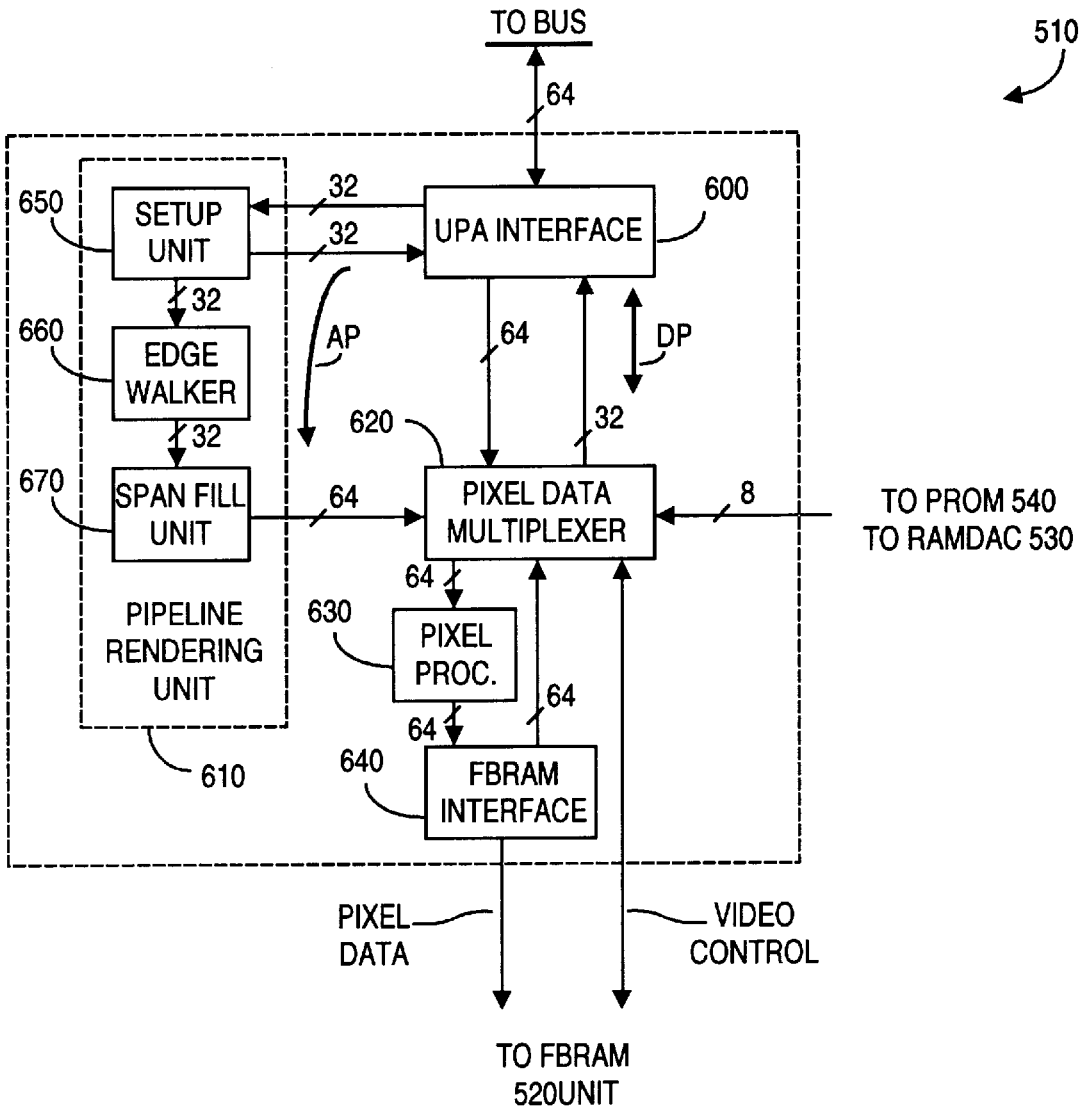
FIG. 5 is a block diagram of a /preferred embodiment of a FFB controller unit, according to the present invention.

FIG. 5 provides a more detailed block diagram of FFB Controller ASIC 510, which diagram is also generally applicable to controller unit 510'. Unit 510 includes an interface unit 610, a pipeline rendering unit 610, a pixel data multiplexer unit 620, a pixel processor 630, and an FBRAM interface unit 640. Interface unit 600 provides bus interface functions and is preferably universal port architecture ("UPA") compatible. Unit 600 is responsible for=for synchronizing data and request access clock domains. For example, packets are decoded to determine size and address destination, which information is used by read and write state machines involved with the transfer of address and/or data from source to destination.

As shown in FIG. 5, data flow between interface unit 600 and pixel data multiplexer 620 can occur using one of two parallel paths: a bilateral direct path ("DP") and a unilateral accelerated path ("AP") via pipeline rendering unit 610. Pixel data multiplexer 620 multiplexes data from the DP and AP for use by pixel processor 630. Pixel processor 630 performs per pixel calculations for data received from the DP and the AP.

The direct path permits the host to bypass the rendering pipeline for such applications that may be better serviced by host-based software. Such applications can include accessing dumb frame buffer (e.g., wherein accesses are stateless and have no pixel processing applied), and accessing smart frame buffers in a manner compatible with older generation frame buffers (e.g., accesses have states and have full pixel processing applied). Other candidates for DP configuration include processing complex primitives that are not supported through the AP configuration.

The accelerated path is via pipeline rendering unit 610, and may be useful to render basic primitives, e.g., dots, vectors, triangles. As described below, pipeline rendering unit 610 provides integer rendering and accelerates system performance, especially for graphic intensive applications such as Windows-based applications, geometry representation, and potential real-time image video processing.

As shown in FIG. 5, pipeline rendering unit 610 includes a setup unit 650, an edge walker unit 660, and a span fill unit 670. Setup unit 650 prepares primitives for downstream pipeline rendering processing, and outputs primitive data. For example, unit 650 receives primitive vertex information, calculates slope and intersect information, and preferably performs all fixed point format calculations. Floating point calculations preferably are performed by the host (e.g., CPU 110 in FIG. 1) before the data is passed into FFB 520, 520'.

Edge walker unit 660 walks each edge of a primitive by interpolating x and y values (and when necessary interpolates Z, R, G, B and alpha values) and outputs edge data. More specifically, unit 660 receives commands, primitive coordinates and attributes from setup unit 650. For example, when processing triangle primitives, edge walker unit 660 decomposes the triangles into scans, adjusts endpoints on the scans, and calculates the number of pixels to be interpolated by span fill unit 670.

Span file unit 670 performs calculations required for each span of a primitive, and outputs pixel data, and essentially functions as a span interpolator and as a fill/copy engine. For dot, line and span primitives, unit 670 issues single pixel writes to pixel data multiplexer 620. For two-dimensional polygons and rectangles, unit 670 issues four-pixel masks to unit 620. Unit 670 preferably also performs anti-aliasing, end-point adjustment, and shading, depending on various attributes.

As further shown in FIG. 5, pixel data multiplexer 620 interfaces with pixel processor unit 630, with frame buffer RAM ("FBRAM") interface unit 640, and with FBRAM unit 520. Unit 620 arbitrates requests from both the accelerated path AP and direct path DP, preferably on a per pixel arbitration basis, with priority being given to the DP port. Preferably arbitration permits a current owner to continuously maintain address and data paths when there is no other request. In a preferred embodiment, multiplexer 620 decodes an op code field in the request to determine destination, e.g., to pixel processor 630, to RAMDAC 530, or to PROM 540. Multiplexer unit 620 converts address, data, or control information into an appropriate format for RAMDAC and PROM destinations. The conversion includes unpacking preferably 32-bit works into four 8-bit bytes for writes, and packing four 8-bit bytes into 32-bit words for reads.

Pixel processor 630 performs per-pixel calculations for both AP and DP configurations. Processor 630 also performs viewport clipping, font, screen door transparency, pattern fill, source blending, current window ID, pixel merge, alpha clipping, and depth cuing functions.

FBRAM interface unit 640 controls data transfers to and from FBRAM unit 520, 520', manages a FBRAM data cache, and performs video and dynamic RAM refresh functions for the video frame buffer. Write operations from FBRAM interface 640 to FBRAM 520, 520' may be two (parallel) interleaves at a time, or one interleave at a time (e.g., to each of the interleaves separately). The ability to write two interleaves at a time can advantageously reduce time needed to load a background color into FBRAM. FBRAM unit 520 receives pixel data signals from the output of FBRAM interface 640, and couples video control signals to and from pixel data multiplexer 620. FBRAM unit 510 provides video data signals to RAMDAC unit 530, whose output may be coupled to monitor 30.

Figure 6:
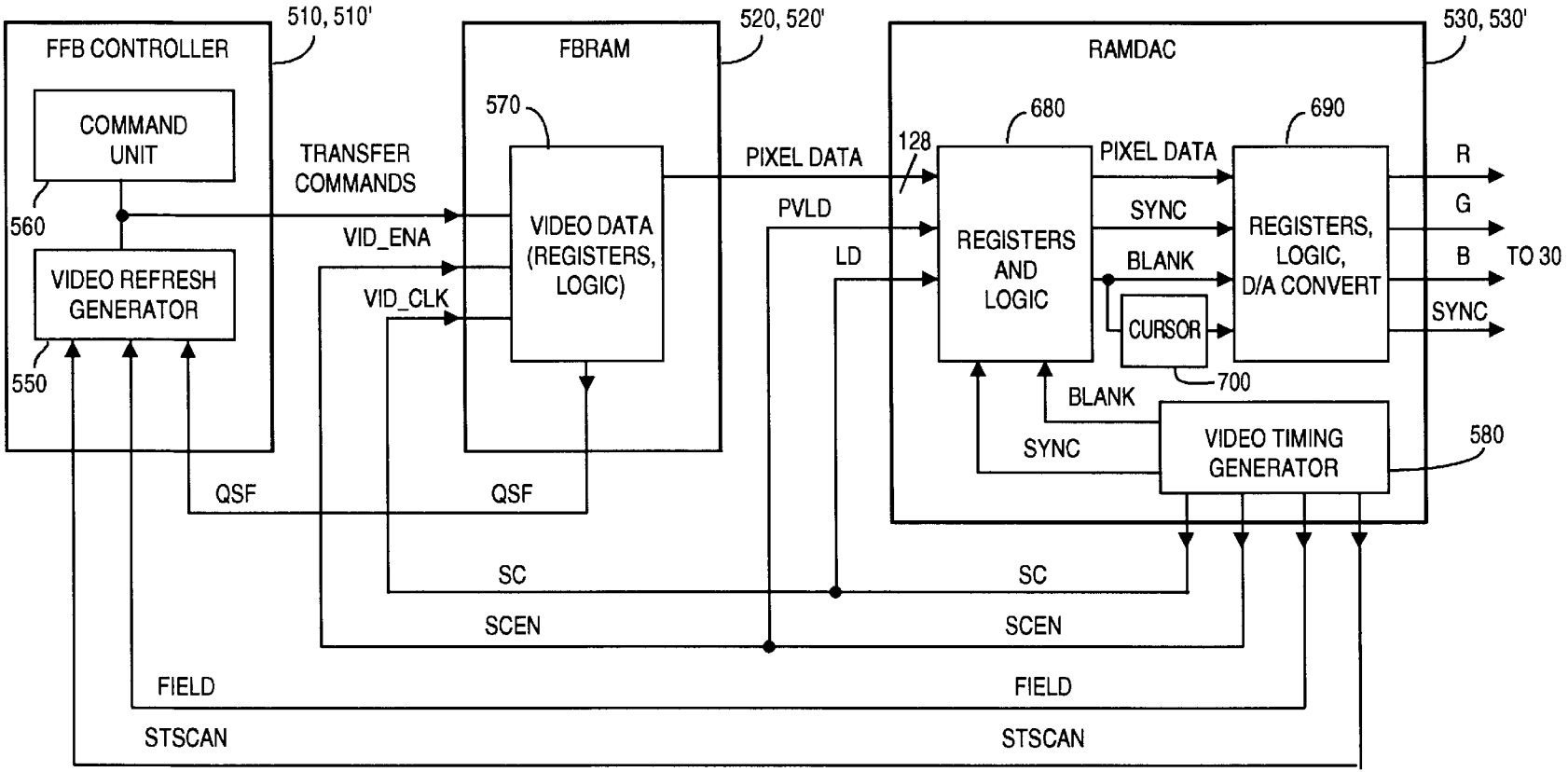
FIG. 6 is a block diagram of the present invention depicting signal flow.

FIG. 6 depicts the present invention from a signal flow perspective, and demonstrates the role of timing generator 580. Timing generator 580 preferably is programmable and operates from the serial clock ("SC") to provide video and timing signals, including video display and video memory timing reference signals composite sync ("CSYNC"), STSCAN, FIELD, and serial clock enable ("SCEN"). Further, BLANK and SYNC signals from timing generator 580 are input to RAMDAC registers and logic 680. Logic 680 also receives pixel data from FBRAM unit 570, PVLD and LD signals from generator 580.

Processed pixel data, SYNC, and BLANK signals are input by unit 680 to additional registers and logic and a digital-to-analog converter per se (collectively unit 690) within RAMDAC 530, 530'. Preferably the processed pixel data comprises 128 lines of pixel data. The BLANK signal from unit 680 is also input to a cursor generator unit 700, whose output is coupled to unit 690. Unit 690 then generates the red, green, blue, and SYNC output signals, which are then input to monitor display 30.

CSYNC is a composite video synchronization signal that includes horizontal and vertical synchronization signals, and optionally a serrated synchronization signal. CSYNC is coupled to display monitor 30 as a discrete signal, or by adding to the green channel signal output from RAMDAC 530, 530'. (The sync-on-green and other composite synchronization options preferably are controlled by register programming.)

STSCAN is provided as a pixel port output signal and is interpreted by external circuitry as the start of each visible horizontal scan line. STSCAN is used to index video memory. In the preferred embodiment, the single STSCAN signal is used in lieu of HBLANK and VBLANK signals to advise the frame buffer when the next visible line of active video is anticipated. In response, the frame buffer will increment Y and reset X video address coordinates, and will load the shift registers within the FBRAM unit. This practice permits using a single RAMDAC output pin to convey STSCAN information, rather than use two separate pins, one each of HBLANK and VBLANK. In this implementation, STSCAN goes active just before each visible line, which implies that the frame buffer need only monitor FIELD and STSCAN to learn precisely what data to load when for video shift output.

SCEN is a serial clock enable signal that is used to clock-out pixel data, and preferably is active during active unblanked video time. SCEN is programmable through registers that control the start and end of vertical blanking. Preferably two registers control start and end of SCEN in horizontal blanking. SCEN preferably is programmed for the same duration as the active (unblanked) horizontal time.

According to the present invention, SCEN is programmed to precede the active horizontal period by N cycles of the system clock. The value N is the number of system clock delays from sampling SCEN with the system clock, to the scanline's first pixel output incremented by one (SCEN setup). As such, N represents the number of SC cycles governing memory system pipeline delay for pixels clocking-in at the RAMDAC pixel data inputs. In this fashion, pixel data will align properly with BLANK and SKEW signals, notwithstanding that these signals do not have the same skew associated with the pixel data. This advancing of SCEN will be described later herein with respect to FIGS. 7 and 8 herein.

Timing generator 580 preferably is operable under host control as either a master or slave. Master mode operations is preferred to slave mode as special hardware setup is not needed when using multiple FBRAM units.

FIELD is a bidirectional signal that is an input signal when the timing generator 580 (including a sync generator) is operated in slave mode. During slave mode, the input FIELD signal is used to set horizontal and vertical generator elements so that they correspond to the start of vertical synchronization. A FIELD signal transition causes a vertical counter to be reset at the next horizontal sync occurrence. When the timing generator is in master mode, FIELD is an output signal used in stereo and interlaced display formats to indicate which field is displayed, e.g., left or right.

In interlaced display formats, FIELD differentiates between odd and even fields, and within FFB controller unit 510, 510', the y coordinate video address will be reset to FIELD on FIELD transitions. In sequential display formats, FIELD indicates frame start. In non-interlaced sequential display formats, FIELD simply indicates the start of the frame, and within the FFB controller unit, the y coordinate video address is reset to zero. External circuitry uses FIELD to index video memory and to control stereo shutters used in stereo viewing.

FIELD changes state congruent to vertical synchronization. FIELD toggles at start of vertical sync, and FBRAM control logic (shown in FIG. 6 as part of unit 570) uses the transition to determine when start of a vertical sync event occurs. The level of vertical sync is important for interlaced video formats to enable FBRAM control logic to know which video field is to be displayed. The level may also be used to determine the left or right field of a stereo display. Further, FIELD may be used to trigger stereo glasses.

In a preferred implementation, timing generator 580 includes a 32-bit control register that controls display formats, composite sync and equalization signals, and the timing generator master/slave mode. While the timing parameter registers are being programmed, the timing generator should be disabled.

Within the control register, bit field D<6> is an interlace mode ("IM") bit (0=non-interlaced mode; 1=interlaced mode) that selects the timing generator operating mode. Bit field D<5> is a master mode ("MM") bit that controls FIELD signal direction. D<5>=0 is slave mode, for which RAMDAC uses the externally provided FIELD signal to start at the top of a new frame, and D<5>=1 is master mode, for which the RAMDAC generates the FIELD signal.

Control register bit field D<4> is an equalization disable ("ED") bit (0=equalize enabled; 1=equalize disabled). Equalization pulses occur if the RAMDAC is in interlaced mode and the ED bit is set to 0. Otherwise, CSYNC should look like the non-interlaced case, when horizontal syncs occurring on CSYNC except during vertical sync. During vertical sync! CSYNC has serration pulses.

Bit field D<3> is a vertical sync disable ("VD"), 0=VSYNC enabled; 1=VSYNC disabled. Bit field D<2> is horizontal sync disable ("HD"), wherein 0=HSYNC signal enable (which causes signals HSYNC_L and CSYNC_L to be enabled, active low); 1=HSYNC signal disabled, which disables HSYNC_L and CSYNC_L signals. Bit field D<1>is Timing generator enable ("TE"), in which 0=disabled; 1=Enabled. D<1>enabled Causes the timing generator to restart at the beginning of the upper left corner of an even frame, the change being effective at the next rising edge of the internal timing generator clock. Finally, control register bit field D<0>is video enable ("VE"). D<0>=0 is disabled, which blanks the RAMDAC outputs (i.e., HBLANK_L, CBLANK_L, and VBLANK_L are all active low). Pixel data will be zero for any signature acquired during the video disable state. D<0>=1 is enabled, which disables HBLANK_L, CBLANK_L, and VBLANK_L.

As further shown in FIG. 6, video refresh generator 550 receives FIELD and STSCAN signals from video timing generator 580, and receives a QSF status video synchronization signal from registers and logic (shown as 570) within FBRAM unit 520, 520'. The video refresh generator outputs transfer commands to the registers and logic located in the FBRAM. The FBRAM registers and logic also receive SC and SCEN signals from the RAMDAC-located video timing generator.

Figure 7:
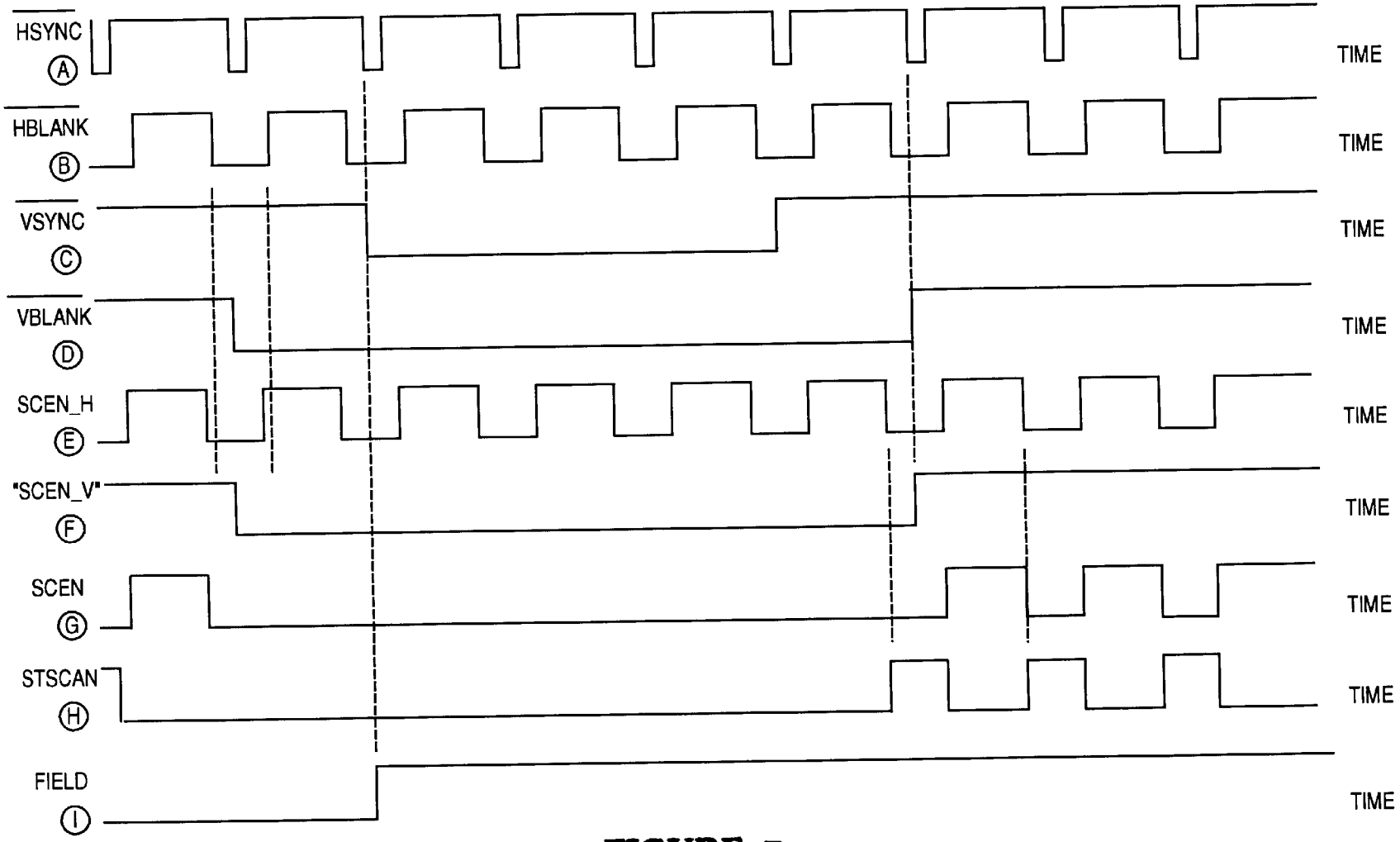
FIG. 7 depicts field and synchronization timing relationships, according to the present invention.

FIG. 7 depicts timing relationships for various field and synchronization signals generated within RAMDAC unit 530, 530'. Waveforms A (complement of horizontal sync), B (complement of horizontal blank), C (complement of vertical sync), D (complement of vertical blank), E (system clock enable horizontal component), F (system clock enable vertical component, which is always equal to the complement of VBLANK) exist internal to the RAMDAC unit, and out not brought out on pins to external circuitry. By contrast, waveforms G (SCAN), H (STSCAN), and I (FIELD) are brought out for use by external circuitry, as shown in FIG. 6. As noted, STSCAN signals FFB controller unit 510, 510' to prepare for the next visible line of data by incrementing Y, resetting X, and loading the FBRAM shift registers. If the next line is visible, STSCAN logic within the FFB controller will set STSCAN at SCEN_H decremented, and will reset STSCAN at SCEN_H incremented.

It is seen from FIG. 7 that the horizontal component SCEN_H of SCEN is advanced by N shift clocks before occurrence of the complement to HBLANK signal.

Figure 8:
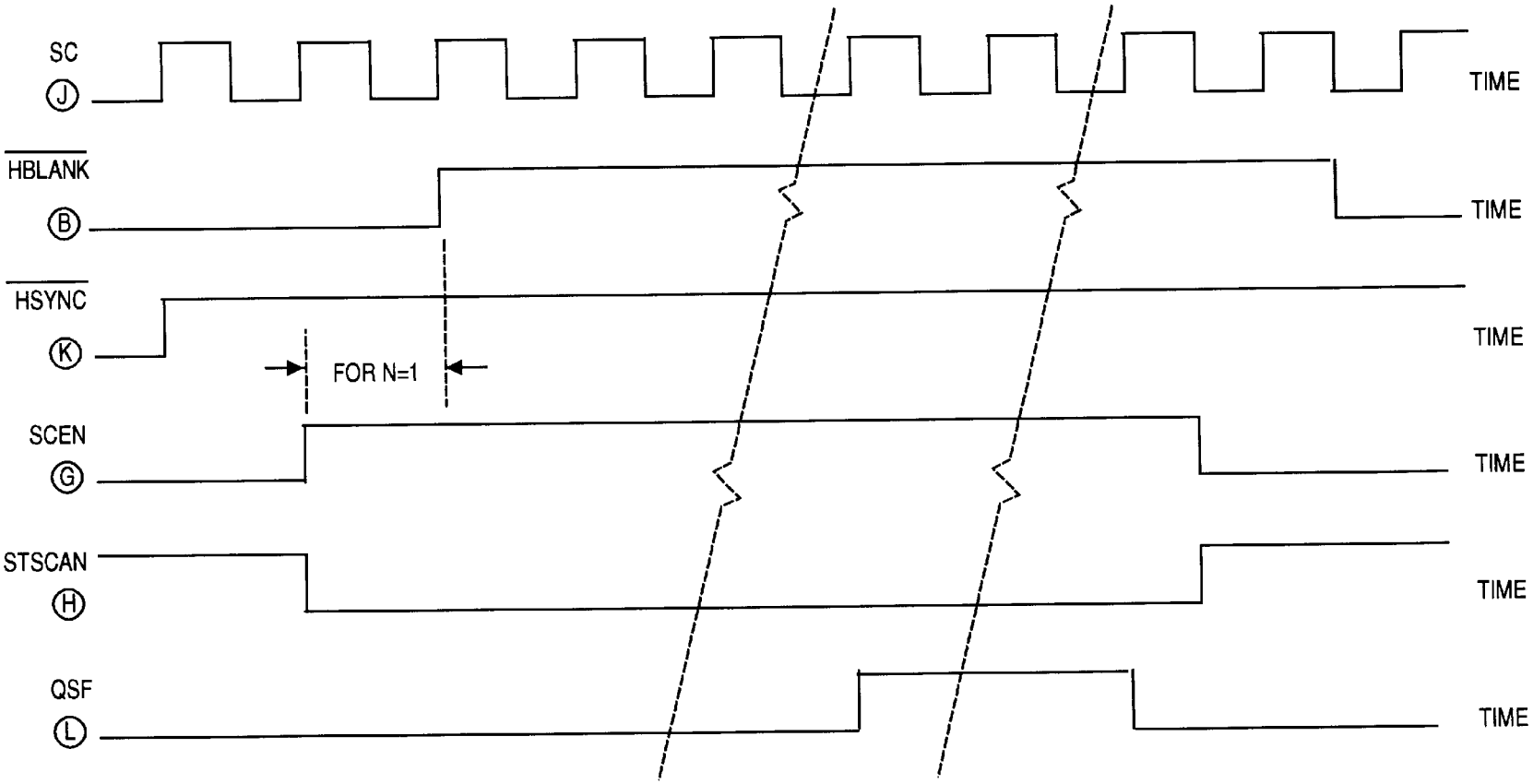
FIG. 8 depicts timing signal advancement in detail within a visible line, according to the present invention.

FIG. 8 provides a detailed view of various clock and timing pulse relationships within a visible line, for the case N=1. As seen, the onset of SCEN occurs precise one system clock period in advance of the complementary HBLANK signal. The diagonal lines traversing FIG. 8 depict that during active video, there will be forty shift clocks ("SC") between QSF transitions (in 1280 pixel display mode).

Figure 9A:
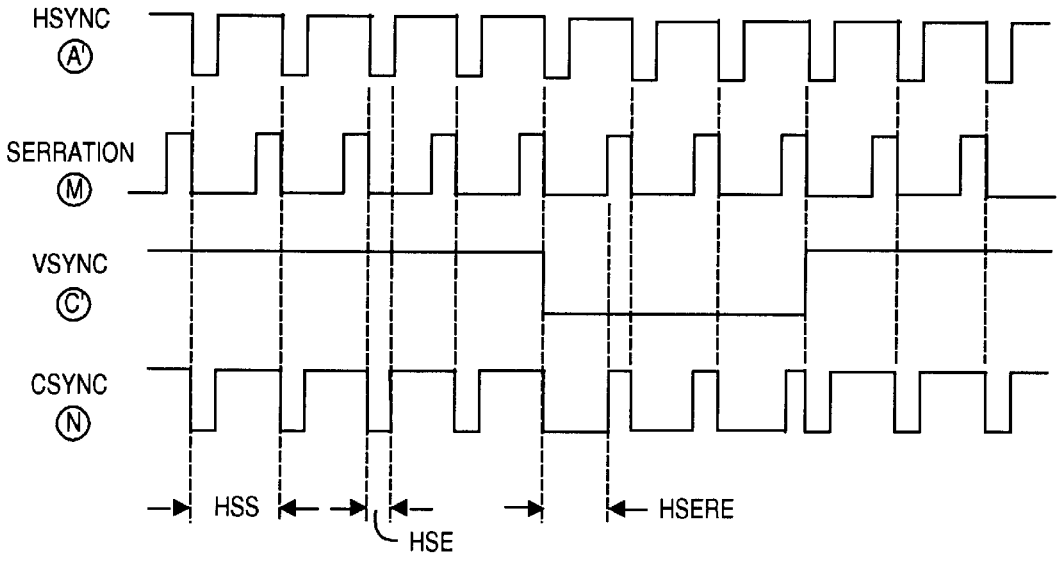
FIG. 9A depicts horizontal timing relationships for a non-interlaced format embodiment of the present invention.
Figure 9B:
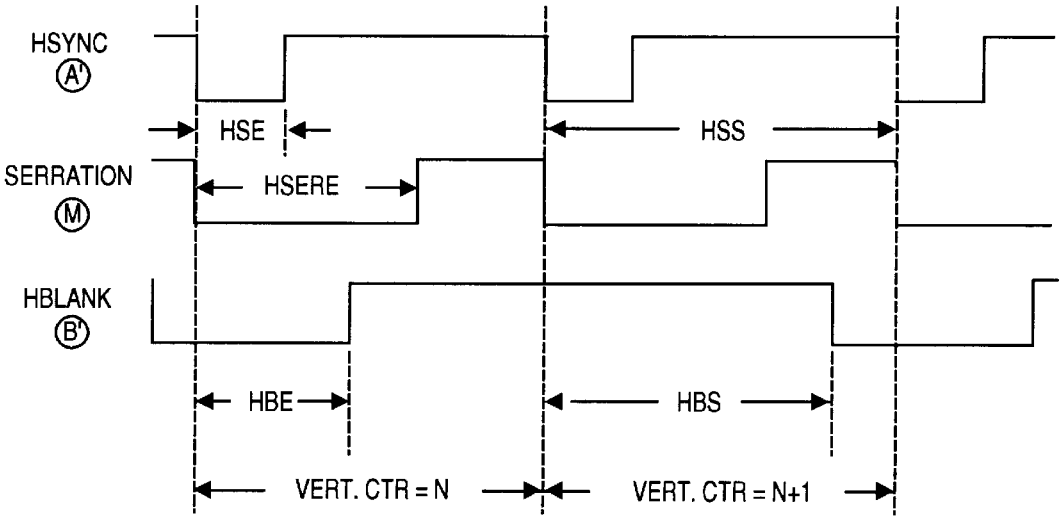
FIG. 9B depicts horizontal timing relationships for an interlaced format embodiment of the present invention.

FIGS. 9A and 9B depict horizontal timing relationships for non-interlaced and interlaced formats, respectively. In these figures, "primed" waveforms denote the uncomplemented version of a waveform in a previous figure. For example, waveform A' denotes the HSYNC signal, e.g., the uncomplemented version of waveform A in FIG. 7. In FIGS. 9A and 9B, HSS and HSE denote, respectively, horizontal sync start and end, HBS and HBE denote, respectively, horizontal blank start and end, and HSERE denotes horizontal serration end. Waveform M is a serration waveform, and waveform N is a composite sync ("CSYNC") pulse.

In the preferred embodiment, timing generator 580 includes eight horizontal registers: HSERE, HBE, HBS, HSE, HSS, horizontal count, horizontal SCEN end ("HSCENE"), and horizontal SCEN start ("HSCENS"). In generating the horizontal signals, HSS, HSE, and HSERE registers are programmed with the desired durations, in pixel clock units.

The HSERE register holds the pixel address that permits sync generator disablement of the serration pulse. The HBE register is used for read/write access and holds the pixel address that permits the sync generator to disable the horizontal blanking pulse. The HBS register is used for read/write access and holds the pixel address that permits the sync generator to produce the beginning of the horizontal blanking pulse. The HSE register is used for read/write access and holds the pixel address that permits the sync generator to disable the horizontal sync pulse. The register value is one less than the desired duration. The HSS register is used for read/write access and holds the pixel address that permits the sync generator to produce the beginning of the horizontal sync pulse. The register value is one less than the desired duration.

The HSCENE register is used for read/write access and sets the pixel address that allows the sync generator to disable the serial clock enable signal SCEN. As such, HSCENE holds the horizontal serial clock enable end pixel address. The HSCENS register is used for read/write access and sets the pixel address that permits the sync generator to produce the beginning of the SCEN signal. The SCEN output enables clocking of serial data from the FBRAM unit. The horizontal serial clock enable must be programmed relative to the horizontal display active interval (i.e., HBLANK). The HSCENS register will hold the horizonal serial clock enable start pixel address.

Timing generator 580 also provides equalization registers to equalize pulse end ("EE"), equalization interval end ("EIE"), and equalization interval start ("EIS"). The EE register holds the pixel address of the last equalization interval. Equalization pulses begin at pixel 0 and typically are half the duration of horizontal sync. The EIE register holds the pixel address that permits the sync generator to finish the equalization interval. The EIS register holds the pixel address that lets the sync generator start the equalization interval.

Timing generator 580 also provides vertical registers used for read/write access that include registers for vertical blank end ("VBE"), vertical blank start ("VBS"), vertical sync end ("VSE"), and vertical sync start ("VSS"). The VBE register holds the line address that permits the sync generator to disable the vertical blanking pulse. As such, this register holds the vertical blank end line address. The VBS register holds the line address that permits the sync generator to produce the start of the vertical blanking pulse. The VSE register holds the line address that lets the sync generator disable the vertical sync pulse, e.g., the vertical sync end line address. The VSS register holds the line address that lets the sync generator produce the start of the vertical sync pulse.

Timing generator 580 also includes a read only access vertical counter register that produces the number of vertical scan lines per frame. When the scan line number matches the register contents, and the last pixel in that line has occurred, the vertical counter resets itself in the next clock cycle. Timing generator 580 also includes a read only access horizontal counter register that produces the pixel address. When the value of the horizontal counter matches the register contents, the horizontal counter resets itself in the next clock cycle. As noted, the SCEN signal should be active during unblanked video time, and thus SCEN is programmed in advance of the active horizontal period by the exact number (N) of serial clock cycles that constitute the FBRAM pipeline delay for pixels clocking into the RAMDAC data inputs. In the preferred embodiment, N=1 serial clock cycle.

It is useful to consider timing generator programming for non-interlaced and interlaced mode operation. In non-interlaced timing, the affected registers are VBE, VBS, VSE, VSS, HSERRE, HBE, HBS, HSE, HSS, HSCENE, and HSCENS. Assume a standard 1280×1024 pixel display at a vertical frequency of 76.11 Hz and a horizontal frequency of 81.13 KHz. VSYNC and HSYNC will be enabled, and equalization disabled. The serial clock will be fp/1 (where 4/2:1=2:1 pixel input format is selected). The pixel clock is 135 MHz, the horizontal sync is 0.474 $\mu$s, horizontal unblanked is 9.48 $\mu$s, horizontal blanking is 2.84 $\mu$s, and total vertical lines will be 1066, with 8 lines occurring during vertical sync.

In the above example, if the FBRAM unit has one serial clock period from start of SCEN to clocking-in of pixel data to the RAMDAC input, standard register values will be: VBE 39, VBS 1063, VSE 7, VSS 1065, HSE 799, HBE 175, HBS 815, HSE 31, HSS 831, HSCENE 814 and HSCENS 174.

Consider now an example in which interlaced timing is used, a mode during which half-lines must be considered and in which vertical coordinates are units of half-lines. Certain features such as serration pulses and equalization pulses will occur entirely on half-lines, whereas other features such as SCEN will be active across half lines. In addition to the parameters used for non-interlaced timing, interlaced timing uses three additional parameters to control duration of an equalization pulse, and the number of equalization pulse before and after vertical sync. These parameters are equalization end (EE), equalization interval end (EIE), and equalization interval start (EIS).

For interlaced timing, horizontal blanking will operate on full lines, e.g., on half-line pairs. For field 0, horizontal blanking unblanks on an even half-line and blanks on the following half-line. For field 1, unblanking occurs on an odd half-line and blanks on the following half-line. SCEN operates similarly to horizontal blanking and exhibits the above-described even/odd half line and field behavior. However, only the sense of start and end are reversed in that SCEN is active only when vertical blanking is inactive.

For interlaced timing, vertical blanking is delayed and extended such that half-lines are disabled and only full video lines are displayed. For an odd field, VBLANK starts when the vertical counter is odd and ≧VBS (vertical blank start); for an even field, VBLANK starts when the vertical counter is even and is ≧VBS. For an odd field, VBLANK ends when the vertical counter is odd, and is ≧VBE (vertical blank end). For an even field, VBLANK ends when the vertical counter is even and ≧VBE.

Interlaced display preferably adopts the convention of displaying the top line of the screen from field 0, which allows the RAMDAC to properly order the cursor scan lines. This convention requires that the first line of the FBRAM be shifted out for field 0 and that the second line of the FBRAM be shifted out for field 1. Vertical blank start (VBS) is programmed with an odd value to accommodate this convention, and thus the vertical counter is odd when it matches VBE and for field 0 the vertical blanking ends on the next half line.

For field 1, the end of vertical blanking will be delayed by one half line, since it takes one more half line after the vertical counter matches VBE for the vertical counter to be even. For field 1 the vertical counter must be even for vertical blanking to end. VBS generally may be programmed with either an odd or even value. If VBS has an odd value, the bottom line of the display and the FBRAM will be from field 1. Thus the display will have an even number of lines since the FBRAM and display must start with the top line from field 0. If VBS has an even value, the bottom line of the display will be from field 0. In this instance, there will be an odd number of total lines, one more in field 0 than in field 1.

The composite sync ("CSYNC") signal was shown as waveform N in FIG. 9A. CSYNC may be thought of as the selection (per half scan line) of one of serration, equalization, HSYNC, and logical "0" signals, depending on the vertical counter and the enabling of vertical sync, horizontal sync, and equalization.

In a normal interlaced case with vertical and horizontal sync, and equalization all enabled, selection is as follows. For vertical sync half lines, the serration signal is selected. For the pre-equalization or post-equalization half lines, the equalization signal is selected. For the "other" half lines, HSYNC and logical "0" are alternately selected.

Timing parameters are programmed so that an action may be setup one serial clock earlier than when the action must occur. As a result, selection of HSYNC or logical 0 is determined during the half line preceding the one in which HSYNC or logical 0 is multiplexed to CSYNC.

For an odd field, during the "other" half line intervals, CSYNC is started when the horizontal counter=HSS, and the vertical counter=odd, and CSYNC is ended when the horizontal counter=HSE and the vertical counter is odd. During pre-equalization or post-equalization intervals, CSYNC is started when the horizontal counter=HSS, and CSYNC is ended when the horizontal counter=HSE (the vertical counter being irrelevant). During vertical sync intervals, CSYNC is started when the horizontal counter=HSS, and CSYNC is ended when the horizontal counter=HSERE (the vertical counter value being irrelevant).

For an even field, during the "other" half line intervals, CSYNC is started when the horizontal counter=HSS, and is ended when the horizontal counter=HSE, the vertical counter being even in each instance. During pre-equalization or post-equalization intervals, CSYNC is started when the horizontal counter=HSS, and is ended when the horizontal counter=HSE, the vertical counter value being irrelevant. During vertical sync intervals, CSYNC is started when the horizontal counter=HSS, and CSYNC is ended when the horizontal counter=HSERE, the vertical counter value being irrelevant.

Interlaced mode has only two defined states: HSYNC and VSYNC are both enabled or are both disabled. When both are enabled, the timing generator operates as previously described. However, when both are disabled, CSYNC=0 always.

Consider the following NTSC-format timing example, in which the display is 640 pixels by 480 lines, interlaced mode, VSYNC and HSYNC and equalization all enabled. The serial clock is fp/2 (4/2:1 or 2:1 pixel input format selected), the pixel clock is 12.273 MHz, the horizontal frequency=15.73 KHz, horizontal sync=4.73 μs, horizontal unblanked=52.15 μs, horizontal blanking=11.41 μs, 525 total vertical lines (three lines during vertical sync), vertical frequency=59.94 Hz, 6 equalization pulses before and after vertical sync, 12 full lines after equalization before first unblanked line of field 0. Assuming that the FBRAM has one serial clock period from start of SCEN to clocking-in of pixel data at the RAMDAC input, register values for NTSC format are as follows. VBE 37, VBS 517, VSE 5, VSS 524, HSE 165, HBE 59, HBS 184, HSE 28, HSS 194, HSCENE 183, HSCENS 58, EE 13, EIE 11, and EIS 518.

For interlaced PAL-format, the following example is typical. Assume a display of 768 pixels by 575 lines, VSYNC and HSYNC and equalization enabled, serial clock is fp/2 (4/2:1 or 2:1 pixel input format selected), pixel clock is 14.625 MHz, horizontal frequency=15.62 kHz, horizontal sync=4.79 μs, horizontal unblanked=52.51 μs, horizontal blanking=11.49 μs, 525 total vertical lines (2.5 lines during vertical sync pulse), vertical frequency=50.0 Hz, 5 equalization pulses before and after vertical sync, and 17 full lines after equalization before first unblanked line of field 0.

Assuming that the FBRAM has one serial clock period from start of SCEN to clocking-in of pixel data at the RAMDAC input, register values for this PAL-format example are as follows. VBE 43, VBS 618, VSE 4, VSS 624, HSE 200, HBE 76, HBS 226, HSE 34, HSS 233, HSCENE 225, HSCENS 75, EE 16, EIE 9, and EIS 619.

Modifications and variations may be made to the disclosed embodiments without departing from the subject and spirit of the invention as defined by the following claims.

What is claimed is:

1. A frame buffer system for use with a video display system that is useable with a computer system, comprising:

a frame buffer random access memory sub-system (FBRAM) including a source of digital video data, said FBRAM sub-system storing processed said video data to be displayed by said video display system;

a controller unit including a video refresh generator and a command unit coupled to said video refresh generator, coupled to said FBRAM sub-system and to said computer system, said command unit and said video refresh generator providing transfer commands to said FBRAM sub-system including at least one command reflecting state of video refresh required for said video display system; and a digital-to-analog converter sub-system, coupled to said controller unit and to said FBRAM sub-system, for format-converting said video data for display by said video display system, said digital-to-analog converter sub-system further including a video timing generator that provides timing signals to said frame buffer system.

2. The frame buffer system of claim 1, wherein said video timing generator outputs at least two timing signals selected from a group consisting of (i) a serial clock (SC) signal, (ii) a serial clock enable (SCEN) signal, (iii) a field (FIELD)

signal, and (iv) a start each visible horizontal scan line (STSCAN) signal.

3. The frame buffer system of claim 2, wherein said SCEN signal is active during unblanked video time, and is output by said video timing generator in advance of an active horizontal period a number (N) of serial clock cycles constituting a FBRAM pipeline delay for pixels clocking into said digital-to-analog converter sub-system.

4. The frame buffer system of claim 1, wherein said command reflecting state of video refresh includes at least one command selected from a group consisting of (i) a field timing signal (FIELD), (ii) a start each visible horizontal scan line (STSCAN) signal, and (iii) a status (QSF) signal.

5. The frame buffer system of claim 1, wherein said FBRAM sub-system is configurable to at least one configuration selected from a group consisting of (i) a single-buffer sub-system, and a double-buffer sub-system configured into two buffers of pixel data, and one buffer of depth.

6. The frame buffer system of claim 1, wherein said controller unit provides parallel data paths to said FBRAM sub-system that include an accelerated rendering pipeline path and a direct access path.

7. The frame buffer system of claim 6, wherein said controller unit includes a bus interface, coupleable to said computer system, and a pixel data multiplexer, coupled to said bus interface and to said digital-to-analog sub-system;

said parallel data paths being provided between said bus interface and said pixel data multiplexer.

8. The frame buffer system of claim 6, wherein said accelerated rendering pipeline path is provided by a pipeline rendering unit within said controller unit;

said pipeline rendering unit including at least two units selected from the group consisting of (i) a setup unit, (ii) an edge walker unit, and (iii) a span fill unit.

9. A frame buffer system for use with a video display system that is useable with a computer system, comprising:

a frame buffer random access memory sub-system (FBRAM) including a source of digital video data, said FBRAM sub-system storing processed said video data to be displayed by said video display system;

a controller unit, coupled to said FBRAM sub-system and to said computer system so as to provide parallel data paths to said FBRAM sub-system that include an accelerated rendering pipeline path and a direct access path; and a digital-to-analog converter sub-system, coupled to said controller unit and to said VRAM sub-system, for format-converting said video data for display by said video display system, said digital-to-analog converter sub-system including a video timing generator that provides timing signals to said frame buffer system, said timing signals including at least serial clock pulses and a serial clock enable (SCEN) signal; wherein said serial clock enable (SCEN) signal is active during unblanked video time and is output by said video timing generator in advance of an active horizontal period a number (N) of serial clock cycles constituting a FBRAM pipeline delay for pixels clocking into said digital-to-analog converter sub-system.

10. The frame buffer system of claim 9, wherein said controller unit includes a pipeline rendering unit provides said accelerated rendering pipeline path;

said pipeline rendering unit including at least two units selected from a group consisting of (i) a setup unit, (ii) an edge walker unit, and (iii) a span fill unit.

11. The frame buffer system of claim 9, wherein said controller unit includes a video refresh generator and a command unit coupled thereto;

said video refresh generator and said command unit providing transfer commands to said FBRAM sub-system including at least one command reflecting state of video refresh required for said video display system.

12. The frame buffer system of claim 9, wherein said FBRAM sub-system is configurable to at least one configuration selected from a group consisting of (i) a single-buffer sub-system, and (ii) a double-buffer sub-system configured into two buffers of pixel data, and one buffer of depth.

13. A method of providing frame buffer video data for use in a video display system useable with a computer system, the method including the following steps:

(a) providing a frame buffer random access memory sub-system (FBRAM) that includes a source of digital video data, said FBRAM sub-system storing processed said video data to be displayed by said video display system;

(b) coupling a controller unit, which controller unit includes a video refresh generator and a command unit coupled thereto, to said FBRAM sub-system and to a said computer system; and (c) coupling a digital-to-analog converter sub-system to said controller unit and to said FBRAM sub-system for format-converting said video data for display by said video display system, said digital-to-analog converter sub-system including a video timing generator that provides timing signals to said frame buffer system;

(d) causing said command unit and said video refresh generator to provide said FBRAM sub-system with transfer commands that include at least one command reflecting state of video refresh required for said video display system.

14. The method of claim 13, wherein at step (c) said video timing generator outputs at least two timing signals selected from a group consisting of (i) a serial clock (SC) signal, (ii) a serial clock enable (SCEN) signal, (iii) a field (FIELD) signal, and (iv) a start each visible horizontal scan line (STSCAN) signal.

15. The method of claim 14, wherein at step (c), said SCEN signal is active during unblanked video time, and is output by said video timing generator in advance of an active horizontal period a number (N) of serial clock cycles constituting a FBRAM pipeline delay for pixels clocking into said digital-to-analog converter sub-system.

16. The method of claim 13, wherein at step (b) said controller unit is provided with a video refresh generator and a command unit coupled thereto;

wherein said video refresh generator is coupled to said video timing generator to receive therefrom a field timing signal (FIELD) and a start each visible horizontal scan line (STSCAN) signal, and to receive from said FBRAM sub-system a status (QSF) signal;

said command unit and said video refresh generator being coupled to provide transfer commands to said FBRAM sub-system.

17. The method of claim 13, wherein step (a) includes providing said FBRAM sub-system configurable to at least one configuration selected from a group consisting of (i) a single-buffer sub-system, and a double-buffer sub-system configured into two buffers of pixel data, and one buffer of depth.

18. The method claim 13, wherein at step (b), said controller unit provides parallel data paths to said FBRAM sub-system that include an accelerated rendering pipeline path and a direct access path.

19. The method of claim 18, wherein step (b), includes providing a pipeline rendering unit to provide said accelerated rendering pipeline path;

wherein said pipeline rendering unit includes at least two units selected from a group consisting of (i) a setup unit, (ii) an edge walker unit, and (iii) a span fill unit.

20. A method of providing frame buffer system for use with a video display system that is useable with a computer system, the method including the following steps:

(a) providing a frame buffer random access memory sub-system (FBRAM) that includes a source of digital video data, said VRAM sub-system storing processed said video data to be displayed by said video display system;

(b) coupling a controller unit to said FBRAM sub-system and to said computer system so as to provide parallel data paths to said FBRAM sub-system including an accelerated rendering pipeline path and a direct access path; said controller unit including a video refresh generator and a command unit coupled thereto; wherein said video refresh generator and said command unit provide transfer commands to said FBRAM sub-system that include at least one command reflecting state of video refresh required for said video display system; and (c) coupling a digital-to-analog converter sub-system to said controller unit and to said VRAM sub-system, for format-converting said video data for display by said video display system, said digital-to-analog converter sub-system including a video timing generator that provides timing signals to said frame buffer system, said timing signals including at least serial clock pulses and a serial clock enable (SCEN) signal.

21. The method of claim 20, wherein:

said command reflecting state of video refresh includes at least one command selected from a group consisting of (i) a field timing signal (FIELD), (ii) a start each visible horizontal scan line (STSCAN) signal, and (iii) a status (QSF) signal.

22. The method of claim 20, wherein:

at step (c), said serial clock enable (SCEN) signal is active during unblanked video time and is output by said video timing generator in advance of an active horizontal period a number (N) of serial clock cycles constituting a FBRAM pipeline delay for pixels clocking into said digital-to-analog converter sub-system.

23. The method of claim 20, wherein:

at step (b) said controller unit includes a pipeline rendering unit providing said accelerated rendering pipeline path;

said pipeline rendering unit including at least two units selected from a group consisting of (i) a setup unit, (ii) an edge walker unit, and (iii) a span fill unit.

* * * * *